US005145153A

United States Patent [19]

Glynn

[11] Patent Number: 5,145,153

[45] Date of Patent: Sep. 8, 1992

[54] PORTABLE HANDRAIL COUNTER-WEIGHT SYSTEM

[75] Inventor: William Glynn, West Suffield, Conn.

[73] Assignee: Sinco Incorporated, East Hampton, Conn.

[21] Appl. No.: 650,930

[22] Filed: Feb. 5, 1991

[51] Int. Cl.[5] ..... E04H 17/22

[52] U.S. Cl. ..... 256/59; 256/DIG. 6; 248/162.1; 248/910

[58] Field of Search ..... 248/162.1, 910; 182/142; 256/DIG. 6, 64, 59

[56] References Cited

U.S. PATENT DOCUMENTS 2,507,880 5/1950 Bell ..... 256/64
4,647,042 3/1987 Bruce ..... 273/26 E
4,792,258 12/1988 Goff ..... 404/6
4,909,483 3/1990 van Herpen ..... 256/59

FOREIGN PATENT DOCUMENTS 1386189 12/1964 France ..... 248/910

*Primary Examiner*—Randolph A. Reese
*Assistant Examiner*—Heather Chun
*Attorney, Agent, or Firm*—Chilton, Alix & Van Kirk

[57] ABSTRACT

A modular portable handrail system employs cantilever arm/counter-weight anchor assemblies. Bases attach to opposing ends of the cantilever arms. A pail-like receptacle is receivable on one of the bases and interlockable with the base. The receptacle is filled with water, sand or other material to provide the counter-weight mass.

19 Claims, 2 Drawing Sheets

PORTABLE HANDRAIL COUNTER-WEIGHT SYSTEM

BACKGROUND OF THE INVENTION

This invention relates generally to portable handrails which are mounted near the edges of a roof to protect workers thereon. More particularly, the present invention relates generally to portable handrail systems which are supported in place by means of a cantilever counter-weight system.

Portable handrail systems have long been employed to protect workers on roofs or other elevated structures. Conventional portable handrail systems are modular systems which are assembled on a given job site in accordance with the specific work constraints. Commonly, such systems employ a base which supports an upright post. The base/post assemblies are spaced along the edge of the roof. Rails connect between the upright posts to form the handrail system. Counter-balance assemblies extend from some of the post bases. Such assemblies conventionally include a crooked cantilever arm which extends inwardly from the roof edge. A heavy weight is positioned to overlay an end portion of the cantilever arm. The weight conventionally takes the form of a concrete block with a handle or other suitable portable weight.

The foregoing cantilever/counter-weight systems provide an effective and reliable means for securing a safety handrail in a relatively immovable position to the roof or edge of an elevated surface without requiring direct attachment to the base structure Naturally, disassembly is also facilitated by the modular system and the absence of any direct securement structures. Conventional portable handrail systems are relatively bulky and do present transportation difficulties due to the cantilever/counter-weight structures.

SUMMARY OF THE INVENTION

Briefly stated, the invention in a preferred form is a cantilever counter-weight system for supporting a portable safety handrail at a roof edge. The system employs a multiplicity of bases and T-posts which are supported on the bases in generally upright relationship. Pairs of rails extend between sockets in the ends of cross members of the T-posts. A cantilever arm connects with a selected base and extends inwardly from the edge of the roof for connection with a similarly configured base. A pail or receptacle is dimensioned to overlay the base and interlock with the base. The pail is structured so that it may hold a liquid such as water, granular matter such as sand or any other suitable dense material which may be used as a weighting material and is available at the job site.

In one embodiment, the receptacle has a tandem container arrangement and includes a medial locking tube. The locking tube is received in the corresponding shoe which projects vertically from the base for securing the T-posts in the upright position. A second locking shoe extends generally transversely relative to the upright shoe for receiving the inward end of the cantilever arm. An L-shaped handle threadably locks the cantilever arm with the base. The receptacle or pail is relatively light weight and thus may be easily transported to the job location. On-site materials such as water, sand or gravel are loaded into the receptacle to provide the counter-weight mass. The counter-weight system may be relatively easily disassembled by dumping the counter-weight mass from the receptacle so as to provide a relatively light weight transportation mode for the modular assembly.

An object of the invention is to provide a new and improved counter-weight system for a portable safety handrail.

Another object of the invention is to provide a new and improved modular handrail system having relatively light weight components which may be easily transported to and from the work structure.

A further object of the invention is to provide a new and improved portable handrail system which provides an efficient cantilever/counter-weight system without requiring permanent fixed weighted masses.

Other objects and advantages of the invention will become apparent from the detailed description and the drawings.

DETAILED DESCRIPTION OF THE PREFERRED EMBODIMENT

Figure 1:
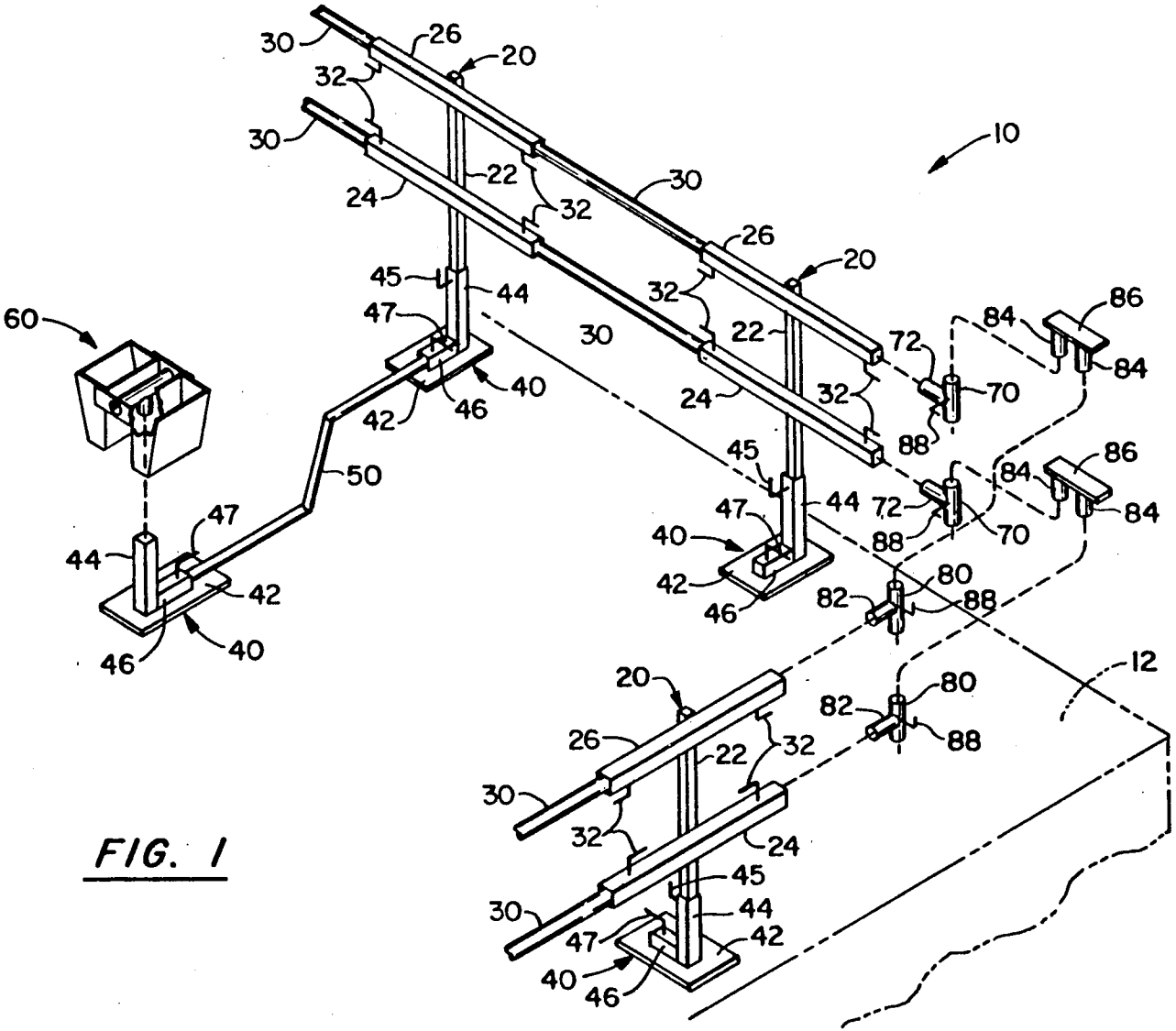
FIG. 1 is a perspective view, partially exploded and partially in schematic, of a modular hand rail system and a counter-weight system therefor in accordance with the present invention.

With reference to the drawings wherein like numerals represent like parts throughout the figures, a portable handrail system incorporating a cantilever counter-weight assembly in accordance with the present invention is generally designated by the numeral 10. The handrail is preferably employed as a temporary safety barrier to protect workers on a roof or elevated structure 12 during construction or maintenance activities. The handrail system 10 is a modular system which is transported to the job site and assembled. The handrail is positioned adjacent the edge of the elevated structure. When the job is completed, the handrail system is disassembled, packaged and transported to storage or the next job site.

The handrail system 10 includes a plurality of substantially identical T-posts 20, each comprising a post 22 and a pair of spaced cross members 24,26. The cross members are preferably formed of tubular sections steel which define sockets at the opposing ends thereof. Rails 30, which may be elongated bars, tubular members or beams, are inserted into the sockets. The rails 30 ar locked in place by L-shaped locking handles 32 threaded to the cross members adjacent each socket end.

Each T-post 20 is supported in an upright orientation by a base 40. The base 40 comprises a base plate 42 which rests on the surface of the elevated structure in generally surface-to-surface relationship. A vertically projecting shoe 44 mounted at a intermediate position of plate 42 is dimensioned to closely receive and support the upright T-post 20. A locking handle 45 threaded to the shoe 44 secures the T-post to the shoe. A second shoe 46 defines a socket for receiving one end of cantilever arm 50 which is locked in place by means of a locking handle 47. The cantilever arm shoe 46 extends generally perpendicularly to the upright post shoe 4 and is parallel with the base plate 42. The shoes 44,46 may be manufactured from sections of square tubular steel. The plate 42 functions as a balance foot.

The cantilever arm 50 may have a crooked configuration terminating in a second end which is received in a cantilever arm shoe 46 of a second base 40. The cantilever arm is then locked to the base by torquing handle 47. The cantilever arm 50 extends inwardly from the edge of the elevated structure 12 to functionally connect with the counter-weight.

Figure 2:
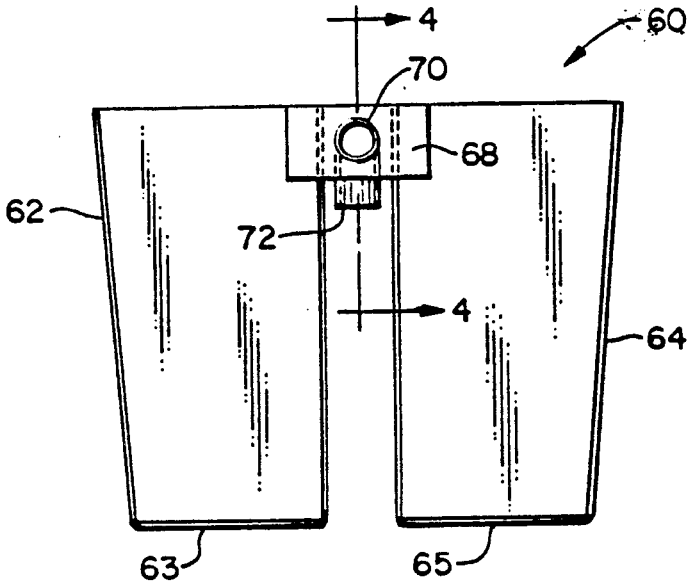
FIG. 2 is a side sectional view, partly broken away, of a pail which may be employed in the counter-weight system of FIG. 1.
Figure 3:
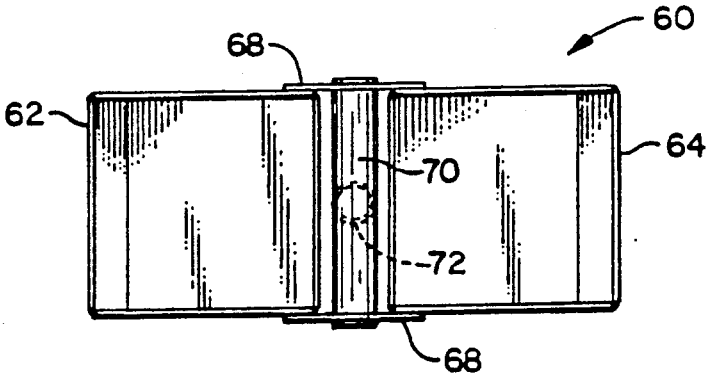
FIG. 3 is a top plan view, partly in phantom, of the pail of FIG. 2.
Figure 4:
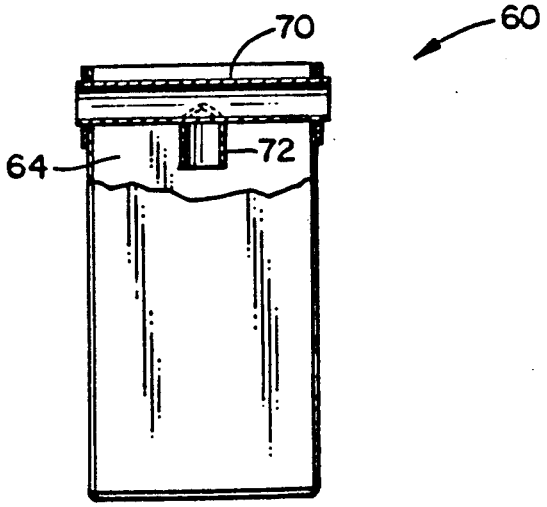
FIG. 4 is a sectional view, partly broken away, of the pail of FIG. 2 taken along the line 4—4 thereof.

With additional reference to FIG. 2–4, a receptacle or pail which has a tandem container configuration is generally designated by the numeral 60. The containers 62,64 are substantially identical and include respective flat bottom panels 63,65 and tapered side panels. The containers are connected at their upper portions by plates 66 which mount a recessed medial carrying handle 70. The carrying handle 70 may be formed from a steel tube. The containers 62,64 are spaced and dimensioned so that they rest on the base plate 42 and overlay the intermediately positioned upwardly projecting post shoe 44 and the cantilever arm shoe 46. A locking tube 72 projects downwardly from the medial handle 70 and is receivable in the upper open socket end of the upright post shoe 44 for locking the receptacle 60 to the base 40. The bottom panels 63,65 rest on opposing sides of the base plate 42. The described receptacle 60 is configured so that multiple receptacles may be stacked in nested fashion.

The containers 62,64 may be formed of metal, plastic or other suitable material and preferably have a relatively light weight durable construction which is also fluid tight. After the pail 60 is locked to the base, the pail may be filled with water, gravel or other materials which are available on-site, so as to provide a weighted mass for the counter-weight cantilever system. Alternately, the containers may be filed prior to placement on the base. The handle 70 facilitates transportation of the filled container.

In preferred form, the corresponding upright T-posts 20 and bases 40 are assembled and locked into position. The corresponding rail pairs are inserted into the cross members 24,26 and locked in position. The post/base/-rail assemblies are arranged along the edge of a roof in accordance with the specific dimensional constraints. A cantilever arm 50, corresponding base 40 and receptacle 60 may then be appropriately mounted and locked in position from each post/base, every other post/base or at selected locations as required.

The modular handrail system is relatively easily adaptable to provide a corner angle by means of extensions 80 which include a lug 82 insertable into the socket ends of the cross members 24,26. The extensions 80 are secured to the rails 30 by the threaded handles 32. The mounted extensions form an upper aperture which receives a pin 84 projecting downwardly from a hinge plate 86. A second pin 84 from the hinge is received in a similar extension 80 mounted in a socket end of an adjacent cross member. Lock handles 88 threaded to the extensions are torqued to lock the pins 84 to the extensions.

It will be appreciated that the foregoing safety system 10 provides an efficient means wherein a compact modular handrail may be easily transported to the roof or other elevated structure without requiring transportation of massive counter-weights. Water, sand and other materials at the job site may be employed as the counter-weight mass during usage. The counter-weight mass may be discarded or removed as required when a system is disassembled. Consequently, the modular handrail system is transformable to a relatively light weight compact configuration when the system is transported to and from the work site. The pails 60 are also preferably configured in a shape as described which permits multiple stacking and thus ensures a compact transportation packaging mode.

The pails 60 may also assume alternate embodiments, such as, for example, a single container embodiment. Preferably, the pails 60 dimensioned to securely rest on the base 40 and to positively lock with the base to provide a counter-weight system of high structural and functional integrity. The pail is also configured to accommodate the cantilever arm connection with the base. Various handle configurations may be employed. The disclosed recessed handle facilitates stacking of the receptacles. The modular system employs substantially identical bases 40 for both the post support and counter-weight connecting structure.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A counter-weight system for supporting a portable handrail on an elevated structure comprising:

base means comprising a plate and first and second shoe means disposed in generally mutual orthogonal relationship above said plate;

receptacle means dimensioned to rest on said base means and generally overlie said first and second shoe means for providing a receptacle disposed above said base means; and locking means for interlocking said receptacle means with said base means.

2. The counter-weight system of claim 1 wherein said locking means comprises a member projecting generally downwardly from said receptacle means, said member being received in said first shoe means.

3. The counter-weight system of claim 1 wherein said receptacle comprises a pair of laterally spaced containers dimensioned and spaced for disposition on opposing sides of said first and second shoe means.

4. The counter-weight system of claim 3 further comprising connecting means for connecting said containers at opposing side portions, a handle mounted to said connecting means.

5. The counter-weight system of claim 4 wherein said locking means comprises a member projecting from said handle.

6. The counter-weight system of claim 1 wherein said receptacle contains water.

7. The counter-weight system of claim 1 wherein said receptacle contains sand.

8. The counter-weight system of claim 1 wherein said receptacle contains matter which generally assumes the shape of the receptacle.

9. A portable handrail system comprising:

a plurality of bases;

a plurality of posts having at least one member extending therefrom and being adapted for generally mounting to said bases for generally upright disposition therefrom;

a plurality of cantilever arms having opposing ends connectable to one of said bases; and a plurality of removable receptacles each receivable on one of said bases wherein material received in said receptacle exerts a downward force on the one of said bases.

10. The portable handrail system of claim 9 wherein one of said receptacles locks with one of said bases.

11. The portable handrail system of claim 9 wherein said receptacle comprises two containers, each having a bottom panel which is dimensioned to rest on one of said bases.

12. The portable handrail system of claim 9 wherein one of said bases comprises a tubular member disposed in generally upright relationship and one of said receptacles comprises a lock member receivable in said tubular member and lockable therewith when one of said receptacles is received on one of said bases.

13. The portable handrail system of claim 9 wherein said receptacles are stackable in nested fashion.

14. A counter-weight system for supporting a handrail on an elevated structure comprising:

first base means comprising a first foot, first post means for supporting a post in generally upright relationship and first arm means for connecting with an end of an arm;

receptacle means dimensioned to rest on said first foot for providing a receptacle wherein material received in said receptacle exerts a downward pressure on said base means, said receptacle means engages said first post means, and said receptacle means is dimensioned so that an arm may be received in said first arm means;

second base means comprising a second foot, second post means for supporting a post in generally upright relationship and second arm means for connecting with an end of an arm;

a post mounted to said second post means; and an arm connecting said first arm means and said second arm means.

15. The counter-weight system of claim 14 wherein said receptacle means comprises two containers.

16. The counter-weight system of claim 14 wherein said receptacle means further comprises a handle.

17. The counter-weight system of claim 14 wherein each said post means and said arm means are manufactured from tubes which define sockets mutually disposed at substantially orthogonal orientations.

18. The counter-weight system of claim 14 wherein said first foot has opposing sections on opposite sides of said first post means and said first arm means, and said receptacle means rests on said first post means and said first arm means.

19. The counter-weight system of claim 18 wherein said receptacle means comprises two containers, each said container resting on one of said sections.

* * * * *